US009925580B1

(12) United States Patent
Rider

(10) Patent No.: US 9,925,580 B1
(45) Date of Patent: Mar. 27, 2018

(54) MOTORIZED CRIMPER APPARATUS

(75) Inventor: Terry L. Rider, Corinth, MS (US)

(73) Assignee: Developmental Industries, Inc., Corinth, MS (US)

( * ) Notice: Subject to any disclaimer, the term of this patent is extended or adjusted under 35 U.S.C. 154(b) by 1025 days.

(21) Appl. No.: 13/190,114

(22) Filed: Jul. 25, 2011

(51) Int. Cl.
*B21D 39/02* (2006.01)

(52) U.S. Cl.
CPC ..... *B21D 39/025* (2013.01); *B21D 39/02* (2013.01)

(58) Field of Classification Search
CPC ..... B21D 39/025; B21D 39/021; B21D 39/02
USPC ..... 72/409.18, 210, 48, 206, 384, 387, 319, 72/457, 479; 29/243.5, 243.58, 283.5
See application file for complete search history.

(56) References Cited

U.S. PATENT DOCUMENTS 3,609,845 A * 10/1971 Taylor ..... 29/243.5
3,731,514 A * 5/1973 Deibele, Jr. ..... B21D 5/045 72/306
3,987,740 A * 10/1976 Merson ..... 29/243.58
4,072,118 A * 2/1978 Schultheiss ..... 72/48
4,372,022 A * 2/1983 Puckett ..... 29/243.58
4,562,721 A * 1/1986 Bleyer ..... 72/384
4,726,107 A * 2/1988 Knudson ..... 29/243.5
4,827,595 A * 5/1989 Dacey, Jr. ..... 72/325
5,243,748 A * 9/1993 Morello ..... 29/243.5
6,115,899 A * 9/2000 Rider ..... 29/243.5
6,796,157 B2 * 9/2004 Stalzer ..... 72/319
6,810,708 B2 * 11/2004 Stalzer ..... B21D 19/043 72/319
8,322,014 B1 * 12/2012 Rider ..... 72/210

* cited by examiner

*Primary Examiner* — R. K. Arundale
*Assistant Examiner* — Mohammad Yusuf
(74) *Attorney, Agent, or Firm* — William S. Parks

(57) ABSTRACT

A motorized crimping mechanism to impart substantially 90 degree crimps to adjacent roof and/or wall panel seams of a fabricated edifice is provided. Such a crimping device allows for substantially uniform seaming along the target contact line of two adjacent panels with substantially similar pressures and torque applied thereto at the selected locations of crimp application. The motorized device itself includes a rotary drive shaft to apply sufficient pressures for 90 degree crimps in two adjacent metal panels, as well as an optional guide to ensure proper placement and direction along the entire contact line between such panels. The invention thus encompasses the device as well as the method of using such a motorized crimper for connecting standing seams of adjacent side edges of two building panels.

4 Claims, 10 Drawing Sheets

MOTORIZED CRIMPER APPARATUS

FIELD OF THE INVENTION

This invention pertains to a motorized crimping mechanism to impart substantially 90 degree crimps to adjacent roof and/or wall panel seams of a fabricated edifice. Such a crimping device allows for substantially uniform seaming along the target contact line of two adjacent panels with substantially similar pressures and torque applied thereto at the selected locations of crimp application. The motorized device itself includes a rotary drive shaft to apply sufficient pressures for 90 degree crimps in two adjacent metal panels, as well as an optional guide to ensure proper placement and direction along the entire contact line between such panels. The invention thus encompasses the device as well as the method of using such a motorized crimper for connecting standing seams of adjacent side edges of two building panels.

BACKGROUND OF THE INVENTION

For as long as sheet metal has been utilized for buildings and like structures, the need for connection adjacent panels from such materials has been required. Since entire large structures cannot be constructed from single metal components, individual portions, in the way of panels, sheets, and the like, have been formed and then connected in various ways. The most prevalent manner of connection has been to place adjacent panel ends over one another and then physically deform the penal ends along a seam to thereby extend the resultant composite in a reliable fashion. Although soldering and screw-type mechanisms are possibilities for such needed connections, such alternatives, though reliable in their own right, are much more labor intensive and expensive in comparison to the above-noted deformation procedures.

As such, the typical manner of providing such physical seams to adjacent sheet metal (or like) panels has been a manual crimping device wherein the user places two juxtaposed ends of a crimping jaw over the two panel ends and manually closes the jaw to apply the needed degree of crimp to ensure proper folding and thus interaction between the panels for a reliable seam. Such a device must be utilized either along the entire panel end connection line to create the necessary water-tight and wind-protective seam, or in specific locations along a subject seam where the panels are connected to the base building structure through clips. In any event, such the utilization of such manual crimping devices requires the user to maneuver himself and the device into correct position and perform the jaw closing and opening for such a purpose over the entire connection line. Over the entire seam, then, being a manual device, the user is hard-pressed to perform uniform crimping over the length of the seam such that a uniform result is applied. Without substantial uniformity, the aesthetic qualities of the seam may be reduced as well as the possible overall protective nature of the seam could be compromised.

Furthermore, the greater the actual entanglement of the seam through excessive deformations of both panel ends, the stronger the overall seamed composite. Thus, if the panel ends are physically manipulated in such a manner as to secure the panel ends together as tightly as possible, then such a resultant seam would be less susceptible to wind updraft damage as and water leakage as the forces required to separate such a seam would be excessive themselves. With a lower degree of deformation of the seam, the easier a wind updraft could detach the panel ends. Likewise, as noted above, the looser the seam, the easier water may enter the construction interior there through, not to mention the easier water could penetrate the seam itself increasing the potential for rust formation and deterioration itself at such locations.

Currently, as alluded to previously, manual crimping devices requiring total user maneuvering and physical movement of the jaw components is the standard in the industry. Such a device allows for thorough deformation and crimping on demand by the user, although without guarantees of uniform application over an entire seam. Thus, although the capability of permitting effective seaming through manual crimping is possible with a relatively inexpensive manner of seaming in this manner, there are numerous drawbacks, unfortunately. For instance, the reliance upon intensive manual labor, particularly in terms of having a user not only apply the crimping action on his own, but also to do so while balancing on, for instance, a roof, creates a potentially hazardous situation not to mention the user would tire rather easily during such procedures. The physical demands on the user to properly align the crimper and then apply the proper pressure and torque to create the necessary crimp are significant and could cause a hazardous situation overall at the site. Even with certain improvements in cushioned handles and other like comfort modifications, there remain significant drawbacks and problems with such hand-held devices, particularly in terms of the intensive labor required for utilization. Furthermore, the difficulty for the user to uniformly apply such a crimping device to each location along a seam could cause significant problems for the overall seamed composite, as noted above. Additionally, such manual jaw-type devices are limited in terms of the total surface permitted for crimping with each procedure. Due to the potential difficulties a user may have manipulating such a crimper, particularly when stationed on a roof, such manual devices exhibit a rather small footprint, allowing the user from 4 to 8 inches of coverage during each crimping stage. Thus, the user is, as noted above, required to perform such a manual procedure multiple times over each panel end seam in order to accord the best engagement of panels possible.

Automatic devices have been developed to run along a length of contacted panel ends without any human involvement in order to quickly create a substantially uniform seam. Such devices include a mechanism to continuously engage and deform the subject panel ends directly as well as a motorized system for self-propulsion. Such prior machines have proven very effective and thorough, but they also require a initial crimp within the subject seam for proper placement and engagement of the apparatus with the target panel ends. Also, as noted above, some roof systems do not require a crimp along the entire seam with panel end deformations only necessary at specific clip locations wherein the roof panels become attached to the subject building. Thus, for some construction projects, these motorized automatic and self-propelled crimping devices would be superfluous, but all such projects would require a certain degree of crimping that today is undertaken manually for the most part. As well, the costs for such motorized and wheeled devices are rather high as compared with manual types.

There is one particular partially automatic crimping device, from U.S. Pat. No. 4,072,118, to Schultheiss, that includes two parallel crimpers present within the same overall machine. Such crimpers, however, are limited in their movements to providing, at best, 45 degree angles to the subject panel ends, thus leaving a rather loose engagement subsequent to completion of the crimping procedure. As such, although the overall device accords some degree of efficiency for the user by permitting seam creation for two separate lines simultaneously, the lack of total effective seam strength militates against utilization of such an automatic crimper overall.

Hence, there remains a distinct need to provide the sheet metal composite industry with a highly reliable and effective automatic crimping mechanism that can withstand repeated use and external environmental conditions, as well as repetitively crimp subject metal end panels to substantially the same degree, thereby according substantial uniformity over the entire resultant seam, and, importantly, all when provided in a manner that a user may undertake without any significant issues in terms of weight and/or cumbersomeness, thus allowing for use in various locations and from myriad angles without trouble. Unfortunately, to date, a part-automatic, part-manual crimping device of such type has yet to be provided the sheet metal composite/metal edifice construction industry.

Advantages and Summary of the Invention

One distinct advantage of the present invention is the capability of applying uniform seam crimping along any desired length of connected end panels. Another advantage is the capability of aligning the inventive seam crimper easily and reliably prior to and during use through simple placement of the inventive device along the flat portion of coupled end panels prior to seam crimping. With a lightweight construction, the inventive seam crimper further permits such effective seam crimping with minimal physical exertion of the user, thereby according yet another advantage. Still another advantage of this invention is the capability of a user to apply a motorized crimper at any portion of a standing seam and apply the necessary deformation thereto as many times as desired.

Accordingly, this invention is directed to a manually movable seam crimping device for crimping a portion of a standing seam of adjacent metal panels when placed in a pre-selected location along said standing seam, wherein said standing seam is provided through contacting engagement of a male end of one metal panel properly nested within a female end of an adjacent metal panel, wherein, when overlapping one another, said standing seam is aligned as a substantially straight line having a vertical component rising to a horizontal component from which extends a flange component, and wherein said flange component extends at an angle of any measurement downward from said horizontal component of said standing seam; wherein said crimping device includes a motorized crimping means to simultaneously bend substantially all of said flange component of said standing seam at the location at which said crimping device is placed (thereby creating a secured seam at the location at which said crimping procedure has occurred). The device can then be manually removed from that specific location and placed at a different one along the same (or a different seam) to create a proper secure connection (seam) at another location in the same manner. Such an invention further includes a device having a rotary driven shaft to allow for such a crimp in the panel ends (edges) sufficient to provide a permanent and strong secured seam. Such a bend in the panel ends should be roughly 90 degrees, with the understanding that if the flange component of the nested panel ends extends at an obtuse angle in relation to the horizontal component of the panel ends, then the angle of deformation would actually be greater than 90 degrees; in this respect, however, the capability of providing deformation through a bend in the panel ends wherein the flange component becomes parallel in relation to the horizontal component of the standing seam should be sufficient for this inventive purpose. The crimping device as defined above with a further guide component included for proper placement of the motorized crimper along the standing seam for substantially uniform application of such crimping actions along the entire seam as desired by a user is also encompassed within this invention. Furthermore, the method of using such a motorized, yet manually transported, apparatus is also encompassed within this invention.

As alluded to above, completely automatic, motorized, and self-propelled seaming devices have been utilized within the metal building industry for such purposes. However, such devices still require priming of the metal seams to a degree that the necessary deformations in the standing seams have already occurred in order to properly place such crimpers in place on, for instance, a roof. Additionally, some roof systems do not require complete seaming along the standing seams in the first place, but only in certain areas at which clips or other connection devices are present to connect the metal panels to underlying purlins or like structural components. Thus, the need for such a motorized, yet manually transported crimping apparatus is apparent.

Such an apparatus is configured to allow for a crimping blade (or board) to rotate at least 90 degrees within the confines of a suitable structural frame and on demand by a user to bend and deform a target flange component of a standing seam to a position substantially parallel to the horizontal component of the same standing seam. The standing seam itself is comprised of two ends of adjacent metal panels, one end configured to cover the other end in a male/female type relation with the male end exhibiting a vertical rise and a horizontal level extending substantially 90 degrees from the vertical rise. The female end will exhibit a like configuration, but with the vertical rise extending upward slightly further than that of the male end, thus allowing the horizontal level to rest on top of the male horizontal level. A flange component then extends from the female end downward from the horizontal level (at any angle, but preferably substantially 90 degrees therefrom) with an optional curved end portion to allow for further reliable nesting of the male and female panel ends, as well as potentially a stronger seam once the crimping/deforming procedure is accomplished. To that end, the rotating crimping blade applies sufficient pressure and torque to bend the flange component of the standing seam inward toward the vertical component thereof until the flange is substantially parallel with the horizontal component. Again, as noted above, such a bend in the flange is substantially 90 degrees, an achievement never achieved in the past with previous manually moved yet motor driven crimping devices (such as in the Schultheiss patent which only achieved 45 degree crimping results). A rotary drive shaft allows for a compact gear drive coupled to a wheel that attaches to the crimping blade. The capability of such a motor configuration thus accords the user not only an effective crimping mechanism for such a purpose and to such a degree, but it also allows for a sufficiently small, lightweight, and portable device that can easily be maneuvered and placed in any location along such a standing seam for operation. In essence, the rotational energy derived from the rotary gear transferring to the wheels translates into linear energy and motion to force the crimping blade into and over the target standing seam.

Additionally, the entire apparatus, preferably being made from metal materials for strength and resilience, at least in terms of the working machinery that applies the sufficient pressures and torque to the target metal panel ends (standing seams)(such metal panels may be sheet metal, aluminum, and any other like material that is strong enough to provide effective shelter and protection from the elements, yet lightweight enough, at least in terms of individual panel and sizes utilized thereof, to be transported and lifted and aligned for seaming to occur). The handles for transport facilitation may be made from strong plastics, if desired. Preferably, however, the overall construction is aluminum as it provides the necessary strength to the device, and is still light in weight to permit ease in transport, lifting and maneuvering, as well.

In actual practice, the user would simply place a male and female end together in overlapping fashion to provide the standing seam noted above and ready for secured seaming. Thereafter, the user would then place the inventive motorized crimper over a selected length of the standing seam, resting evenly upon the horizontal level produced thereby, and then would activate the crimper. The crimper itself includes a lengthwise blade (or board) that is aligned in substantially the same direction as the flange component of the standing seam and thus initially substantially perpendicular to the horizontal component thereof. This blade, being from 4 to 10 inches in length generally, although longer and shorter blades may be employed depending upon the configuration and size of the housing for the motorized crimping device itself, is connected to a extension plate having means to connect itself to two juxtaposed posts present on either side thereof. The posts are themselves connected to rotating wheels at specific parallel locations on either side of a gearbox. The rotating wheels move in concert with the two posts moving together and in the same direction on either side of the extension plate. A gear in the gearbox provides the wheel movement through a worm gear that is positioned tangentially, yet engaged therewith, to the gear itself. Upon introduction of an external source to rotate an extended drive shaft (in relation to the housing in which these components are present) attached to the worm gear (which is present within the housing) to provide the necessary gear movement to effectuate wheel movement, post movement, and ultimately, blade movement. The blade is housed within a curved block whereupon the initiation of movement from the posts on the extension plate causes movement of the blade causing the crimping blade to rotate along an arc, applying pressure and torque to any object in its way as it moves in that direction. In this instance, such curvilinear movement of the blade provides the necessary lift and seaming of the flange component of the target standing seam upon proper placement of the crimper device over the two nested roof panel ends. In essence, the drive posts are attached to the rotating wheels at specific points that, upon rotation of the wheels, allows for the posts to move in a rotational fashion as well. However, with the posts also attached to the extension plate on the blade, the post movements are dictated by the available movement of the blade itself. Since the blade is present in the curved block, the blade itself is driven in such a manner to produce the necessary curvilinear motion for the blade to move upwards into the standing seam as noted. The external drive shaft may be connected with any source that provides the necessary torque thereto to drive the worm gear for the remaining components to move as necessary. Thus, a rotating drill, as one example, may provide such necessary movement. Other sources may include any such twisting device through pneumatic, hydraulic, electric, and the like, energy sources, as well. The rotary gear design coupled with the curved block for movement of the crimping blade in an arc all contribute to the capability of the inventive device to impart the necessary pressure and torque on target metal panel ends, as well as allowing for such a device to be housed in a sufficiently small space to facilitate actual use, as noted above.

As the overall length of the crimping blade may vary, so too may the overall size and length of the overall apparatus itself. In actual practice, the height of the apparatus may not require a measurement beyond 24 inches itself as the torque supplied by the internal rotary drive shaft does not require a significant length for such a purpose. Likewise, the rotating drum allows for a reduced height since the rotation itself generates a significant amount of torque and pressure all within a rather small space (as alluded to above). Thus, the overall apparatus is rather compact and only the crimping blade length appears to create any potential issues in terms of the overall length of the unit.

Once the user has activated the crimping mechanism and the crimping procedure has completed, the wheels continue cycling until the application of torque (twist) to the external drive shaft ceases. As such, the posts will continue to move and drive the crimping blade (through the blade external plate) upward and then return (and thus as it cycles in its own way) within the curved block until the user stops the external energy source moving the drive shaft and applying the necessary drive to the worm gear, etc. As such, the user can continue crimping a specific site on the target standing seam as long as he wishes and then stop the overall movement of the crimping blade and move to another site that requires crimping along the standing seam. The user may choose to stay in one location for at least two crimping procedures simply to ensure that the secure seam has been accomplished beyond a single run. Such should not be necessary, but the user may, again, choose to do so and such would not be outside the scope of the overall inventive method utilizing such a novel apparatus.

DETAILED DESCRIPTION OF THE DRAWINGS AND PREFERRED EMBODIMENTS

Figure 1:
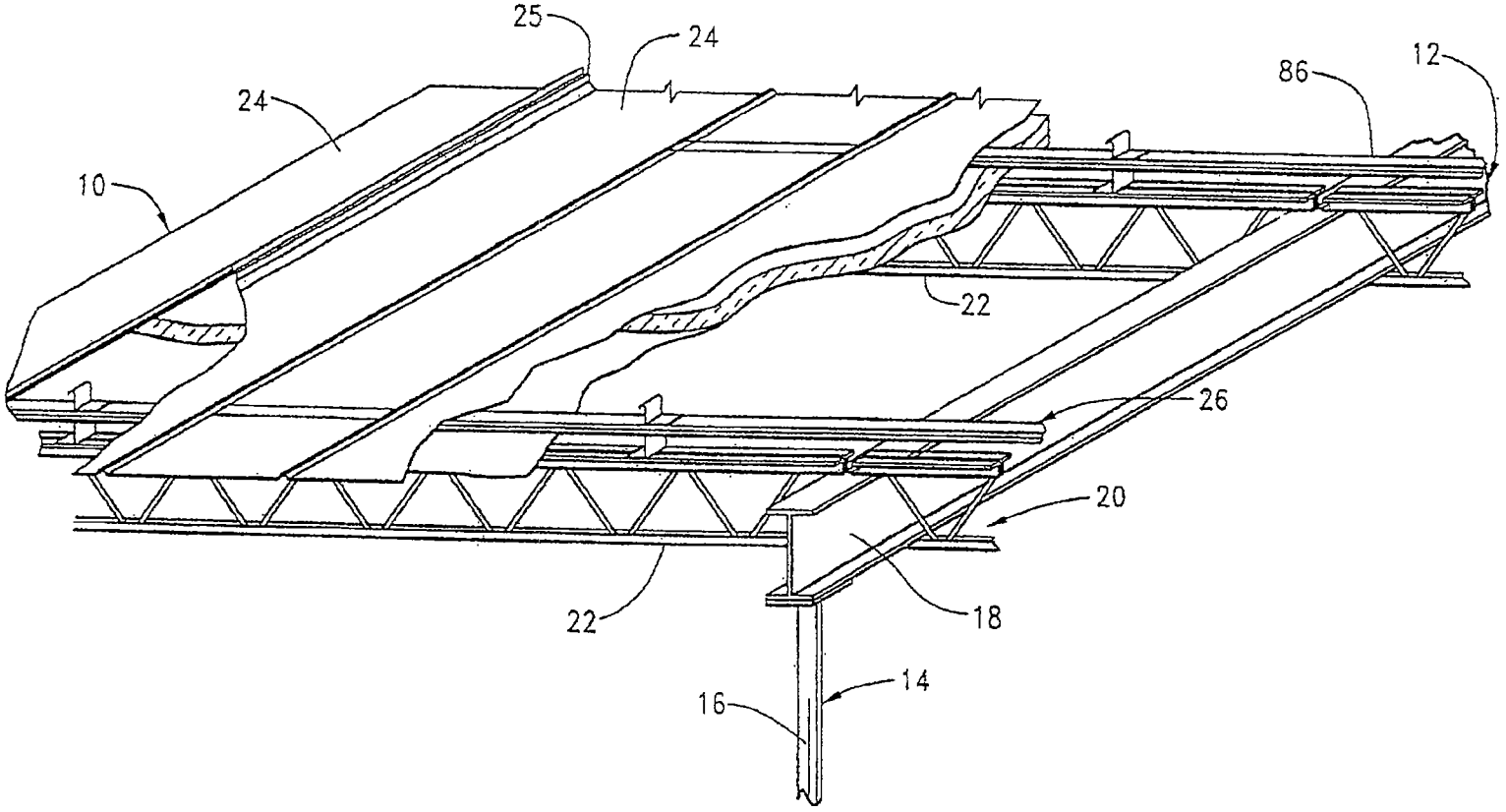
FIG. 1 is an isometric, partial cut-away view of a portion of a roof system utilizing a standing seam roof assembly.
Figure 2:
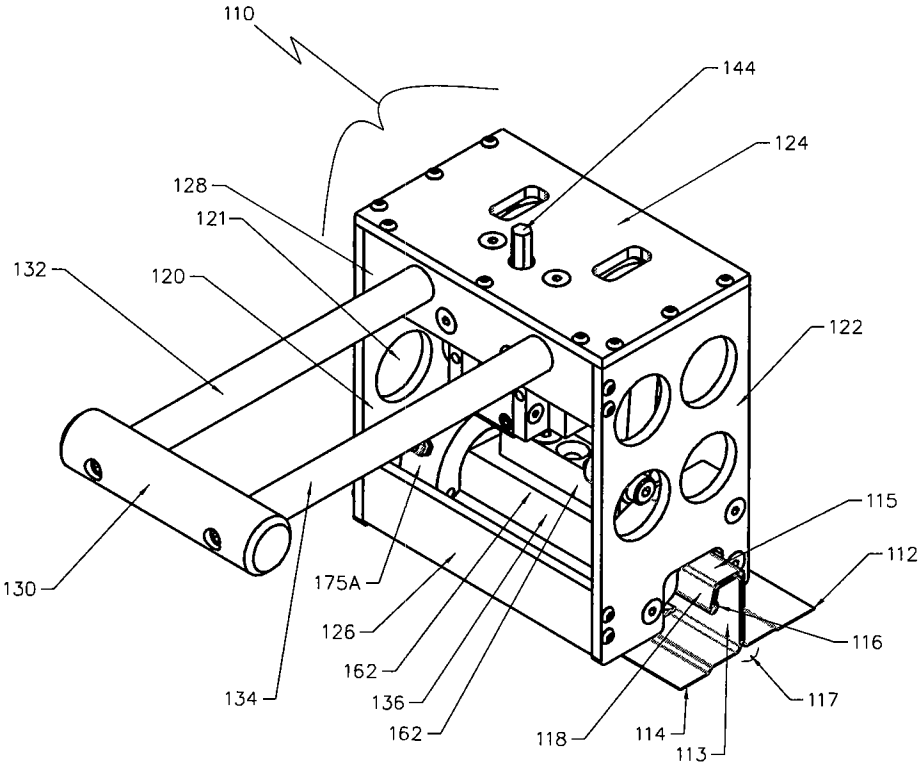
FIG. 2 is a perspective view of one potential embodiment of the inventive seam crimping apparatus as it is applied to contacted metal panel ends prior to seaming.
Figure 3:
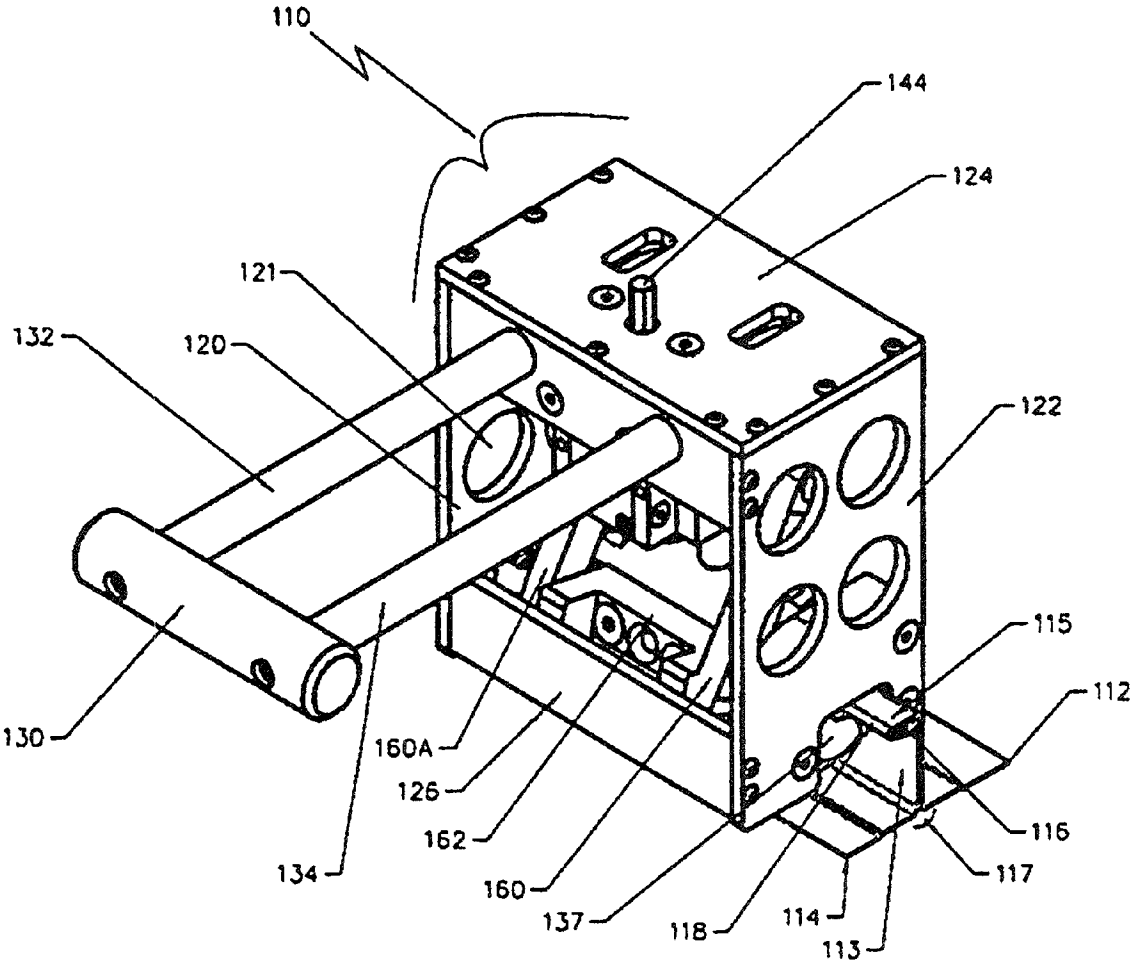
FIG. 3 is a perspective view of the seam crimping apparatus of FIG. 2 subsequent to a crimping procedure.
Figure 4:
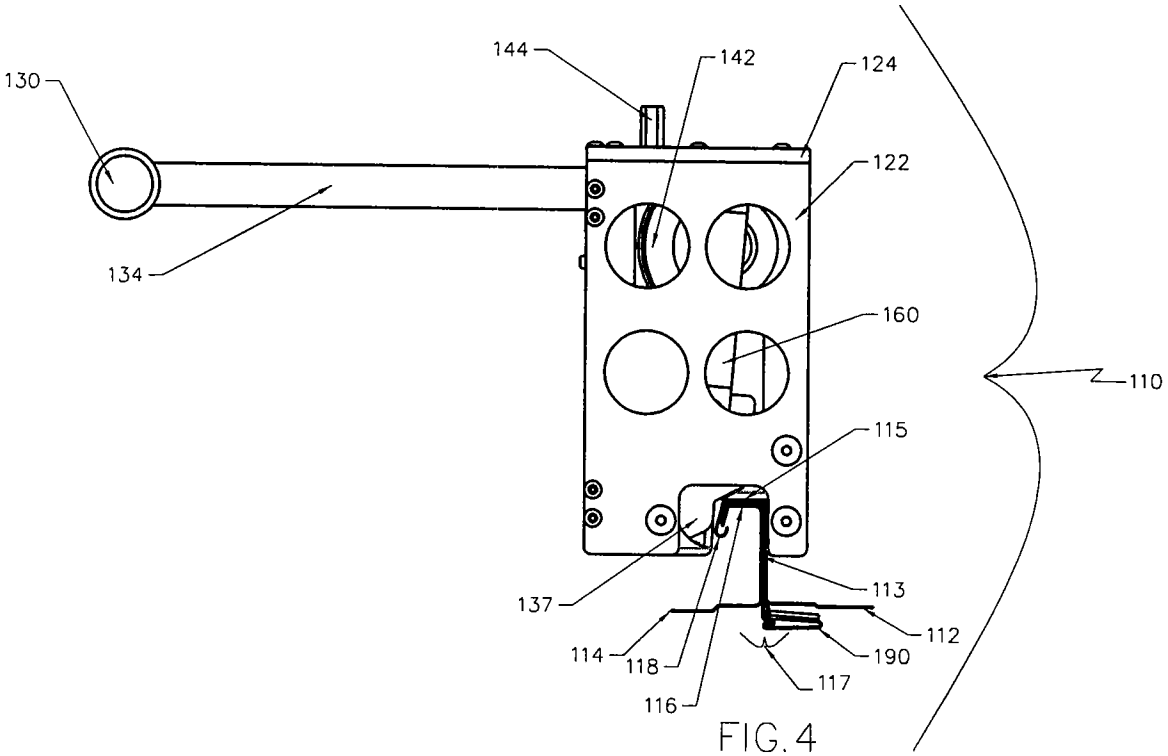
FIG. 4 is a side view of the seam crimping apparatus of FIG. 2 prior to seaming.
Figure 5:
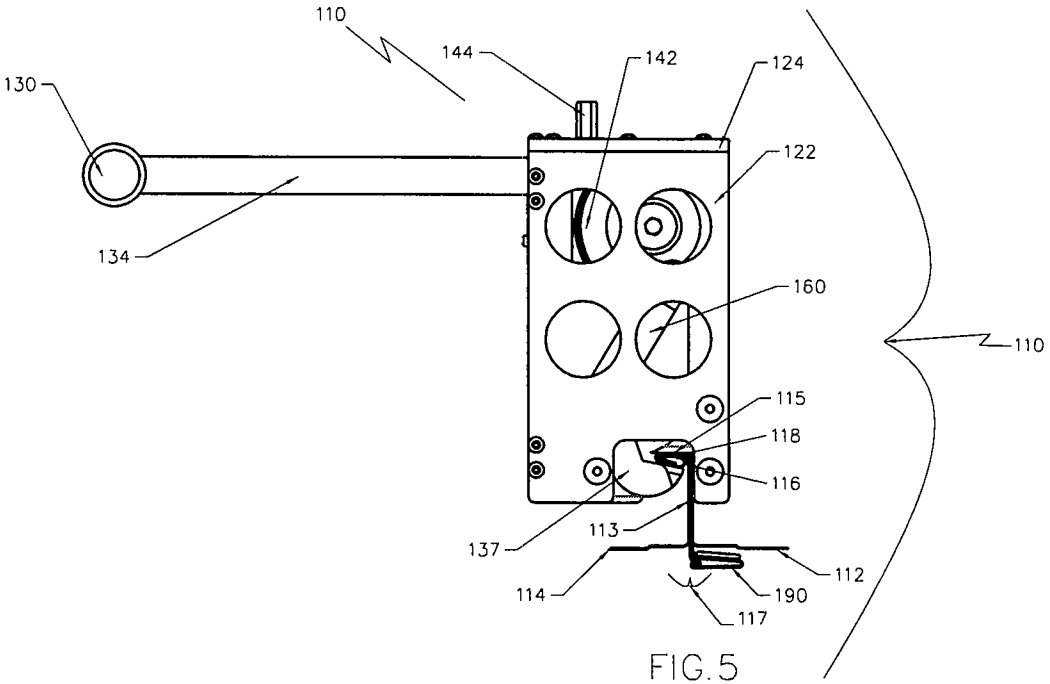
FIG. 5 is a side view of the seam crimping apparatus of FIG. 4 subsequent to a crimping procedure.
Figure 6:
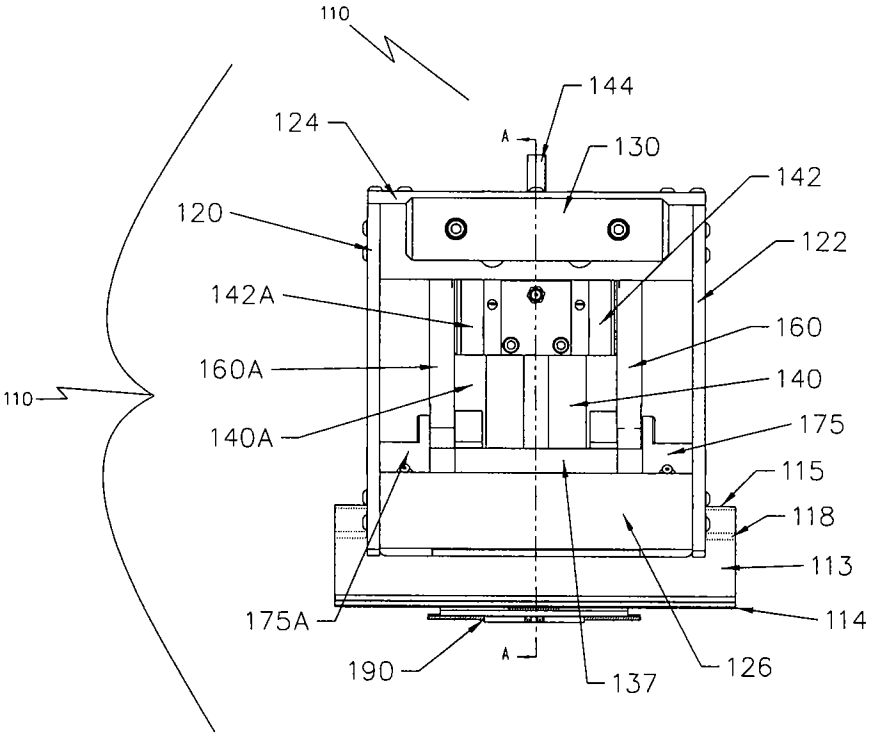
FIG. 6 is a front view of one potential embodiment of the inventive seam crimping apparatus as it is applied to contacted metal panel ends prior to seaming.
Figure 7:
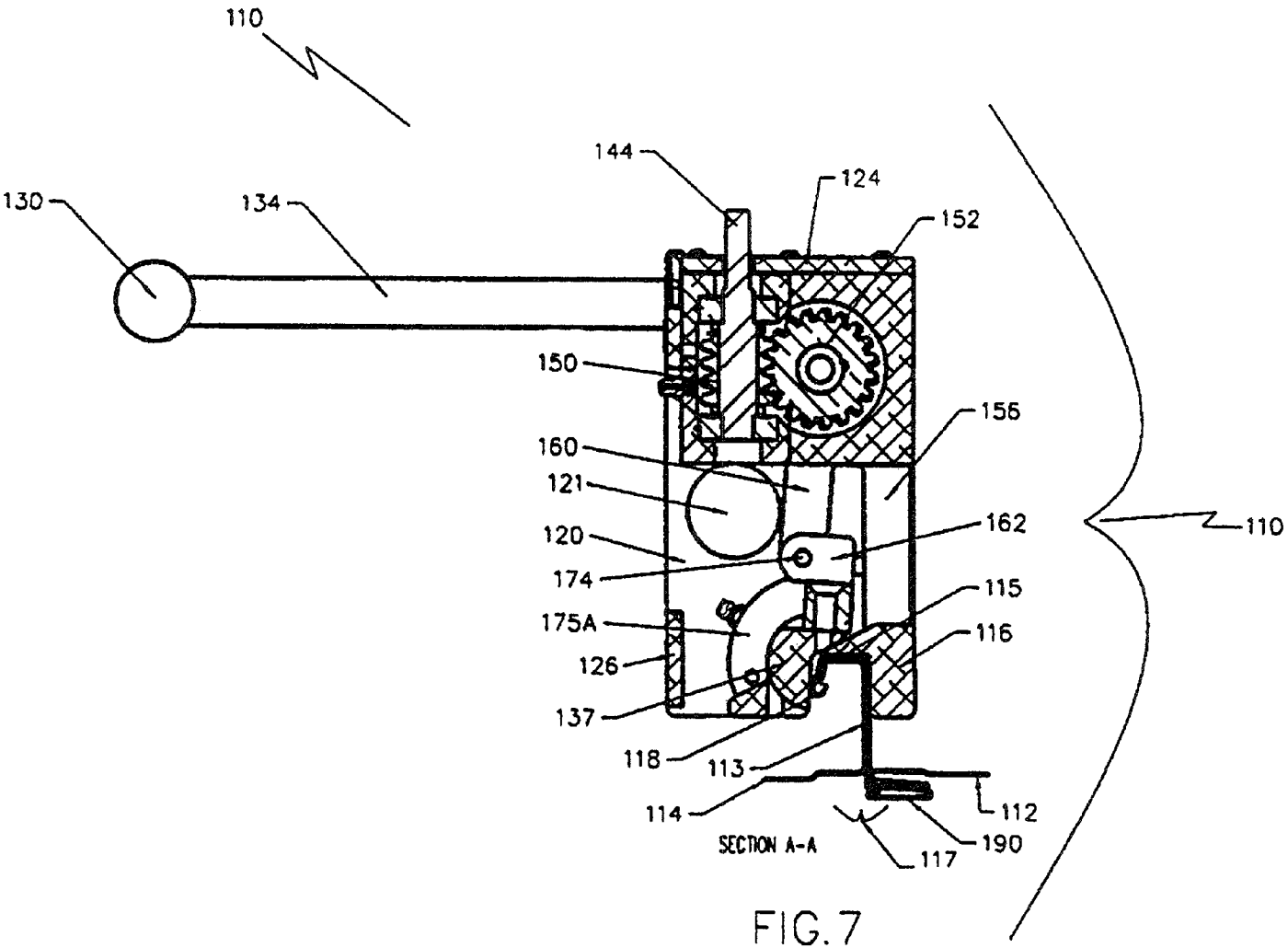
FIG. 7 is a side cut-away view along line A-A of the seam crimping apparatus of FIG. 6.
Figure 8:
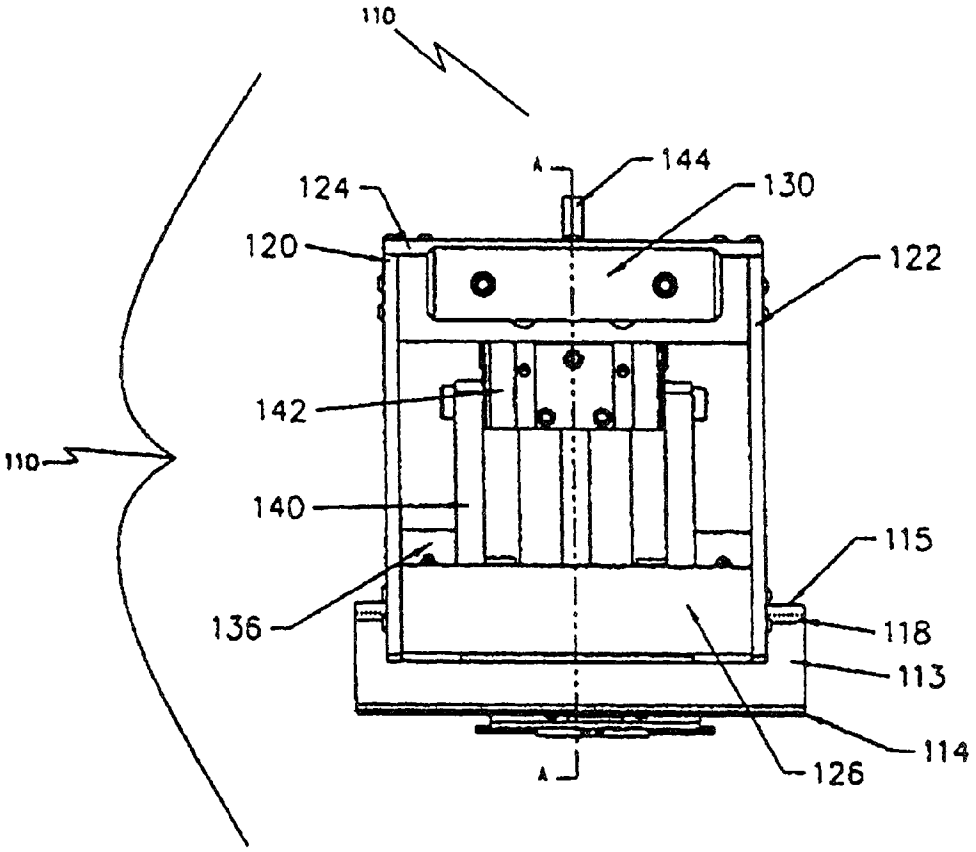
FIG. 8 is a front view of one potential embodiment of the inventive seam crimping apparatus as it is applied to contacted metal panel ends subsequent to a seaming procedure.
Figure 9:
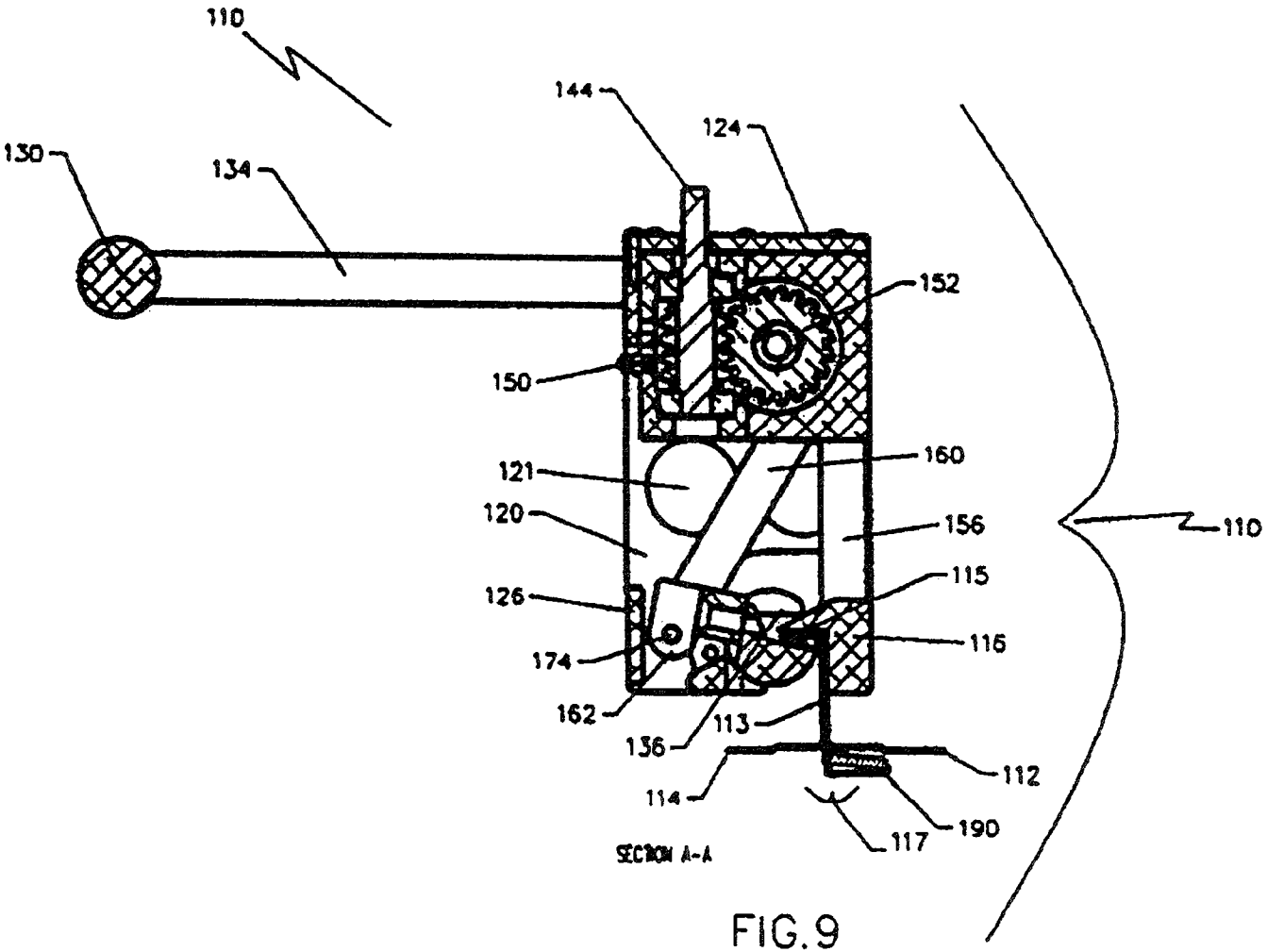
FIG. 9 is a side cut-away view along line A-A of the seam crimping apparatus of FIG. 8.

A better understanding of the present invention will be had when reference is made to the accompanying drawings, wherein identical parts are identified by identical reference numerals. Such a depiction is for a presentation of the potentially preferred embodiments of the invention and is not intended to limit the breadth of the invention in any manner. The ordinarily skilled artisan would have sufficient understanding and respect for this specific art in order to consider the true breadth of the invention itself in relation to the overall descriptions.

Referring to FIG. 1, there is depicted a pre-engineered building roof 10 supported by a pre-engineered building structure 12. Such a pre-engineered structure 12 comprises a primary structural system 14 including a number of upwardly extending column members 16 [to be connected to a base foundation (not illustrated)]. Also, the primary structural system 14 has a plurality of beams 18 which are supported by the column members 16.

Also included is a secondary structural system 20 including a number of open web beams 22 attached to and supported horizontally by the primary beams 18. Alternative structures may be employed in place of these web beams 22, if desired. A plurality of roof panels 24 are supported over the secondary structural assembly 20 by a plurality of panel support assemblies 26 and are attached to the upper flanges of the web beams 22. The roof panels 24, only portions of which are shown, are depicted as being standing seam panels with interlocking standing seams 25 connected by clip portions of the panel support assemblies 26. Alternatives to such clips may be practiced as well and other clips may be incorporated within the panels to hold them in place with the building skeletal portions noted above.

FIGS. 2 through 9 depict one potential embodiment of the inventive motorized crimper apparatus 110. The standing seam 117 is shown formed from a first metal panel female end 112 and a second metal panel male end 114. When in nesting contact together, the panel ends 112, 114 form the standing seam 117 including a vertical component 113, a horizontal component 115, and a flange component 118, as well as a curved end on the female end 116. Placed on the standing seam 117 is the apparatus 110 having two parallel side plates 120, 122 including multiple cut-outs 121 (here they are circular in shape and four in number for this embodiment; actually, no cut-outs are required, nor must they be circular as any shape may be employed) for the purpose of reducing the weight of the apparatus 110 as well as allow for the user a view of the internal motor components during operation. A top plate 124 is present to cover the motor components as well as to allow for the two side plates 120, 122 to be connected in a dimensionally stable fashion. A lower plate 126 and an upper plate 128 thus provides stability on the handle side of the apparatus 110, and a front plate (156 of FIGS. 7 and 9) provides such a benefit as well. In this manner, the motor components are housed within a shelter made from these six plates 120, 122, 124, 126, 128, 156 (at least). The side plates 120, 122 include indentations 123, 125 to accommodate placement of the apparatus 110 onto the horizontal component 115 of the standing seam 117. A handle 130 is attached to the upper plate 128 through stems 132, 134 protruding therefrom. The handle 130 may actually be attached at any desired angle for the user's comfort, and the stems 132, 134 may be of any length for such purpose as well. In this embodiment, the handle 130 is roughly 12 inches from the upper plate 128 and configured to be parallel to target roof panels 112, 114. The actual crimping procedure is accomplished by a crimping blade 136 nested in two curved blocks 175, 175A attached to a extension plate 162 having two connections 174, 174A that are connected to two juxtaposed drive posts 160, 160A. The crimping blade 137 contacts with the flange component 118 of the standing seam 117 during operation. FIGS. 3, 5, 7, and 9 show the deformation of the flange component 118 upon operation of the apparatus 110 by moving the flange component 118 from a position roughly perpendicular to the horizontal component 115 of the flange to parallel to the horizontal component 115. In such a manner, the standing seam 117 becomes secure.

The actual operation of the apparatus 110 involves both manual transport to a selected location along the standing seam 117 as well as actual crimping of the flange component 118 as noted above. The crimping blade 137 provides the necessary pressure and torque application to the target metal panel end components (flange 118, as noted). To do so, the crimping blade 137 moves in a curvilinear (arced) fashion via the direction of the curved blocks 175, 175A. The crimping blade 137 is attached to the two drive posts (shafts) 160, 160A that provide sufficient force for rotational action to commence for the blade 137 due to the connections 174, 174A of the posts 160, 160A to the extension plate 162. The drive shafts 160, 160A are, in turn, attached to wheels 142, 142A that include extensions (166 of FIG. 10, for instance) for connection with the drive posts 160, 160A. The wheels 142, 142A rotate upon rotation of a connected gear 152 and thus move the drive posts 160, 160A rotationally as well. The gear 152 is engaged with a worm gear 150 that rotates longitudinally to create the gear rotation. To accomplish the worm gear movement an extended drive shaft 144 is present to which an external source is connected (not illustrated) to generate rotation thereof. The twisting of the drive shaft 144 thus generates the initiating movement of the worm gear 150 to effectuate all of the remaining rotational, etc., movement for crimping to occur. As noted above, the rotation of the wheels 142, 142A will continue until the external energy source (not illustrated) applying torque to the external drive shaft 144 has ceased. The crimping blade 137 will continue to cycle through the curved block path until such an external source is discontinued. Any type of power generator (electric, pneumatic, hydraulic, and the like) may be attached to the external drive shaft 144 to provide the needed initial torque source for overall activation to occur.

Figure 10:
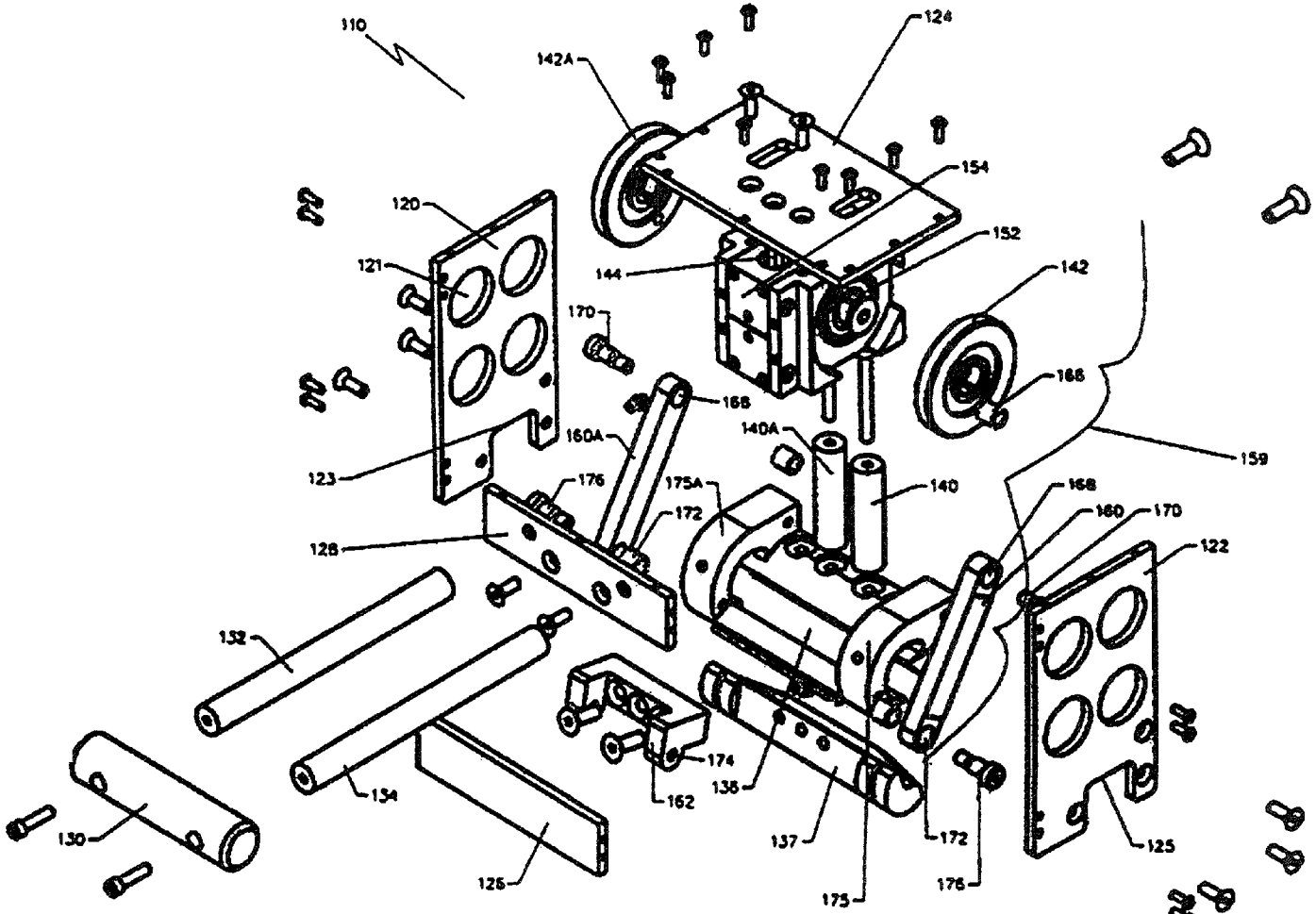
FIG. 10 is an exploded view of a potential embodiment of the inventive motorized seam crimping device.

FIG. 10 shows the individual components of the apparatus 110. The two side plates 120, 122, the top plate 124, the lower small plate 126 and the upper small plate 128 all attach together subsequent to construction of the motor components 159 inside. The crimping blade 137 is attached to the extension plate 162 including two connecting ends 174, 174A for the two actuators 160, 160A to be attached via bolts 176. Two linear support posts 140, 140A connect the gear box 154 to the curved block 175, 175A, as well. The drive wheels 142, 142A include extensions 166 for engagement and connection with openings 168 on the actuators 160, 160A. The drive gear 152 is housed within the gear box 154 and is connected to the wheels 142, 142A to generate the rotation thereof. Securing bolts 170 provide the necessary attachment of the rotating wheels 142, 142A and the diagonal actuators 160, 160A. The gearbox 154 is attached to the top panel 124 through screw connectors (or through bolts; the connections shown in this figure all may be of those types with the appropriate sizes in use for such connections). The handle 130 attaches, as noted above, to the upper small plate 128 via two same-length stems 132, 134.

Thus, a motorized crimping apparatus is provided that may be manually placed at any selected location along a standing seam for appropriate deformation of the seam components for reliable and secure engagement thereof, at least through movement of the flange component of such a standing seam to a location parallel to a horizontal edge formed therein. Such an apparatus has never been provided the metal building industry as of today.

Although the present invention has been described with a certain degree of particularity, it is understood that the present disclosure has been made by way of example and that changes and details of structure may be made without departing from the spirit thereof.

What is claimed is:

1. A movable seam crimping device for crimping a portion of a standing seam of adjacent metal panels when placed in a pre-selected location along said standing seam, said device including a structural frame having two opposing side plates having top ends and bottom ends with bottom edges, said side plates including identical three-sided indentations therein present within said bottom ends of both side plates thereby creating openings within both side plates at the bottom edges thereof, wherein said each of the three-sided indentations has two opposing vertical sides and a horizontal top edge to permit introduction of said standing seam simultaneously at both indentations and for placement of said device on top of said standing seam during utilization at both horizontal top edges, said device further including a curved block within which is a crimping board or blade, said curved block including attached opposing drive posts leading to two opposing rotating gears such that each of the drive posts is connected to one of the rotating gears, wherein said rotating gears rotate in relation to power generated by a mechanical motor attached to said rotating gears, and said rotating gears controlling movement of said crimping board or blade through said opposing drive posts on demand by a user, wherein said crimping board or blade rotates up to 90° within the confines of said structural frame and said curved block and at a pressure sufficient to bend said portion of said adjacent metal panels of said standing seam present within said indentations, and on top of said standing seam said device is placed during operation up to 90° bend.

2. The device of claim 1 wherein said motor includes a rotary drive shaft.

3. The device of claim 1 including a guide component for placement over said standing seam in order to properly align said device prior to crimping.

4. The device of claim 2 including a guide component for placement over said standing seam in order to properly align said device prior to crimping.

* * * * *